United States Patent [19]

Nagaraj et al.

[11] 4,130,415

[45] Dec. 19, 1978

[54] COPPER FLOTATION WITH ANTI-5-NONYL-2-HYDROXYBENXOPHENONE OXIME

[76] Inventors: D. R. Nagaraj, 435 W. 119 St., Apt. 7B; Ponisseril Somasundaran, 560 Riverside Dr., both of New York, N.Y. 10027

[21] Appl. No.: 802,359

[22] Filed: Jun. 2, 1977

[51] Int. Cl.[2] ..... B03D 1/02; C22B 3/00

[52] U.S. Cl. ..... 75/2; 209/11; 209/166; 75/101 BE; 423/24; 423/26

[58] Field of Search ..... 75/2, 101 BE; 209/166, 209/167, 11; 252/61; 423/24, 26

[56] References Cited

U.S. PATENT DOCUMENTS

| | | | |
|---|---|---|---|
| 3,438,494 | 4/1969 | Fuerstenau et al. | 209/166 |
| 3,479,378 | 11/1969 | Orlandini et al. | 423/24 |
| 3,907,966 | 9/1975 | Skarbo | 75/101 BE |
| 3,923,615 | 12/1975 | Kane et al. | 75/101 BE |
| 3,927,169 | 12/1975 | Goren et al. | 75/101 BE |
| 3,939,203 | 2/1976 | Mattison et al. | 75/101 BE |
| 4,008,076 | 2/1977 | Jurgharss et al. | 75/101 BE |

FOREIGN PATENT DOCUMENTS

| | | | |
|---|---|---|---|
| 135431 | 3/1961 | U.S.S.R. | 252/61 |

OTHER PUBLICATIONS

Danilova, E. V., et al.; Obogoshchenie Rud, vol. 20, No. 3, pp. 5–8 (1975).

Ritcey, G. M.; "Solvent-In-Pulp Processing Using Sieve Pulse Columns", *Chemistry and Industry,* pp. 1294–1299 (11/6/71).

DeWitt, C. C.; "Chelate Compounds as Flotation Reagents I", Journal of the American Chemical Society, vol. LXI (5/39), pp. 1247–1249.

Gutzeit, G.; "Chelate-Forming Organic Compounds as Flotation Reagents", *AIME-Transactions,* vol. 169, pp. 272–286 (1946).

Rinelli, G.; "Flotation of Zn and Pb Oxide-Sulphide Ores with Chelating Agents"; Tenth International Mineral Processing Congress 1973, pp. 493–521.

*Primary Examiner*—L. Dewayne Rutledge
*Assistant Examiner*—Michael L. Lewis
*Attorney, Agent, or Firm*—Kane, Dalsimer, Kane, Sullivan and Kurucz

[57] ABSTRACT

The disclosure is of the use of a class of chelating agents having active nitrogen and oxygen chelating atoms and which form insoluble chelates with copper, as reagents for the recovery of for example copper values from copper-bearing materials by froth flotation and like techniques.

5 Claims, No Drawings

COPPER FLOTATION WITH ANTI-5-NONYL-2-HYDROXYBENXOPHENONE OXIME

BACKGROUND OF THE INVENTION

1. Field of the Invention

The invention relates to the use of chelating agents having active nitrogen and oxygen chelating atoms which form insoluble chelates with metals, for the recovery of metal values from ores by flotation and oil extraction flotation techniques and more particularly relates to the use of α and β hydroxyoximes and the like as reagents in such separatory methods.

2. Brief Description of the Prior Art

Although it is a general practice to beneficiate oxide type copper ores through hydrometallurgical methods, flotation beneficiation of oxide ores is possible after a sulfidization treatment using xanthates as collectors. However, flotation methods using xanthates and sulfidizers such as sodium sulfide have not been entirely satisfactory and to date such methods are not a commercial reality. Xanthate, by itself, cannot efficiently collect oxide copper minerals such as chrysocolla and a preliminary sulfidization does not always lead to success; excess sulfide being, in fact, detrimental. Other conventional types of collectors such as fatty acids and sulfonates have also proved unsuccessful as collectors for flotation of oxide copper ores. In addition, the latter types of collectors do not collect sulfide copper minerals.

Often, copper-bearing ore materials have to be ground to a fine size for processing or have to be mined in the form of fines or so-called "slimes". For example, the sodium chloride contaminated sea-bottom deposits contain mineable quantities of copper but are in the form of a slime. Prior art flotation methods using the heretofore known collectors have proved to be both inefficient and uneconomical to recover metal values from fines or slimes.

Clearly, there is a need for "flotaids", i.e.; collectors, modifiers, promotors and activators to improve the flotation of copper ores, both oxide and sulfide types. These flotaids must function efficiently to recover copper values from fines or slimes. It is further highly desirable that the flotaids be selective for copper minerals over the other associated minerals and gangue, irrespective of the size of the ore particles. The choice for such a flotaid would be a reagent which is specific and selective for copper over other metals. We have found a class of compounds which meet these requirements and which function as flotaids for copper in the flotation of copper ores and like procedures.

SUMMARY OF THE INVENTION

The invention comprises in a process of flotation for the separation of metals from a metal-bearing ore, the improvement which comprises the use of a chelating agent which has active nitrogen and oxygen chelating atoms and which forms an insoluble chelate with the metal, as a flotaid.

The term "flotation" as used throughout the specification and claims includes variations of conventional flotation such as oil extraction flotation, oil flotation, and related techniques, oil agglomeration or spherical agglomeration, liquid-liquid extraction-flotation, collector-extender flotation, and emulsion flotation.

DETAILED DESCRIPTION OF THE PREFERRED EMBODIMENTS OF THE INVENTION

The chelating agents employed as flotaids in the improved method of the invention are generally well known compounds possessing active nitrogen and oxygen chelating atoms, i.e.; moieties of the formula:

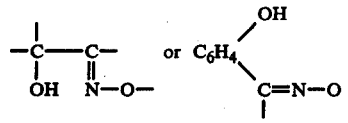

(I) (II)

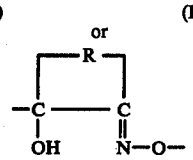

(III)

wherein R is alkylene of 1–10 carbon atoms, inclusive.

The term "alkylene" as used herein means a divalent, aliphatic saturated hydrocarbon moiety of the stated carbon content, for example 1,3-propylene, 1,2-propylene, 2-ethyl-1,3 butylene, 2,4-hexylene, 4,5-decylene and the like.

Compounds containing these groups form copper chelates by replacement of the hydrogen of the OH group and owing to the coordinating property of the nitrogen atom.

Representative of the above defined chelating agents are α-hydroxyoximes within the scope of the formula:

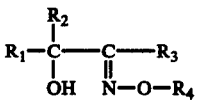

(IV)

wherein $R_1$, $R_2$ and $R_3$ are independently each a group selected from hydrogen, hydrocarbyl, substituted hydrocarbyl, halogen, amine, carboxyl and nitro and $R_4$ represents hydrogen or hydrocarbyl.

$R_1$ and $R_3$ may also be the remainder of an organic polymer whereby the moiety of formula IV is a pendent group on the polymer.

The term "halogen" as used herein is embracive of fluorine, chlorine, bromine and iodine.

The term "hydrocarbyl" as used throughout the specification and claims means the monovalent radical obtained by removing one hydrogen atom from a parent hydrocarbon having from 1 to 20 carbon atoms. Illustrative of such hydrocarbyl groups are alkyl of from 1 to 20 carbon atoms, inclusive, such as methyl, ethyl, propyl, butyl, pentyl hexyl, heptyl, octyl, nonyl, decyl, undecyl, dodecyl, tridecyl, tetradecyl, pentadecyl, hexadecyl heptadecyl, octadecyl, nonadecyl, eicosyl and the isomeric forms thereof; cycloalkyl of from 3 to 20 carbon atoms such as cyclopropyl, cyclobutyl, cyclopentyl, cyclohexyl, cyclohexymethyl, cycloheptyl, cyclooctyl, 2-methylcyclopentyl, 2,3-dimethylcyclobutyl, 4-methylcyclobutyl, 3-cyclopentylpropyl, and the like; polycycloalkyl such as adamantyl and the like; aralkyl such as benzyl, phenethyl, α-phenylpropyl, phenylhexyl, phenyldodecyl, α-naphthylmethyl, and the like; alkenyl such as ethenyl, propenyl, butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosodecenyl and isomeric forms thereof; cycloalkenyl such as cyclobutenyl, cyclopentenyl, cyclohexenyl and the like; aryl of 6 to 20 carbon atoms, inclusive, such as phenyl, o-, m- and p-tolyl, ethylphenyl, xylyl, naphthyl, diphenylyl, anthracyl, dipropylphenylyl and the like.

The term "substituted hydrocarbyl" as used herein means hydrocarbyl as defined above wherein hydrogen atoms have been replaced with one or more amine, halogen, carboxyl or nitro groups.

The compounds of formula (IV) above are α-hydroxyoximes and are generally well known as is their preparation; see for example U.S. Pat. Nos. 3,197,274; 3,224,873; 3,284,501; and 3,294,842 and K. Nogawa et al., Kanazawa Daigaku Kogakubu Kiyo, 3 (3) pps. 236–40 (1964). Representative of the compounds of formula (IV) above are n-butyroin oxime
n-caproin oxime
oenanthoin oxime
furoin oxime
anisoin oxime
cuminoin oxime
piperonyloin oxime
benzfuroin oxime
p-dimethylamino benzoin oxime
p-chloro-p'-dimethylamino benzoin oxime
phenylhydroxyacetamidoxime
19-hydroxyhexatriaconta-9,27-dien-18-one oxime
5-10-diethyl-8-hydroxytetradecan-7-one oxime
5,8-diethyl-7-hydroxy-dodecane-6-one oxime
3,6-diethyl-5-hydroxy-octan-4-one oxime
7-hydroxydodecan-6-one oxime
6-hydroxy-4,7-dimethyl-decan-5-one oxime
6-hydroxy-2,9-dimethyl-decan-5-one oxime
4-hydroxy-2,2,5,5-tetramethyl-hexan-3-one oxime and the like. Polymeric compounds within the scope of the compounds IV are described in Nogawa et al., supra.

Also representative of chelating agents which may be used in the improved method of the invention are β-hydroxyoxime of the formula:

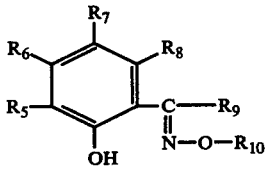

(V)

wherein $R_5$, $R_6$, $R_7$, $R_8$ and $R_9$ are each selected from the groups consisting of hydrogen, hydrocarbyl, substituted hydrocarbyl, alkoxy and aryloxy; $R_{10}$ is hydrogen or hydrocarbyl. The term "alkoxy" as used herein means the monovalent moiety of formula-O-alkyl and the term "aryloxy" means the monovalent moiety of formula-O-aryl wherein alkyl and aryl are as previously illustrated.

Compounds of the formula (V) are also well known as is their preparation; see for example U.S. Pat. No. 3,655,347. Representative of the compounds of formula (V) are:

5-t-octylsalicylaldoxime
2-hydroxy-5-nonyl-acetophenone oxime
2-hydroxy-5-nonyl-valerophenone oxime
benzyl 2-hydroxy-5-nonyl-phenyl ketoxime
2-hydroxy-3-chloro-5-nonyl-benzophenone oxime
2-hydroxy-4-dodecyloxy-benzophenone oxime
2-hydroxy-3-nitro-5-dodecylbenzophenone oxime
2-hydroxy-5-nitro-4'-isopropylbenzophenone oxime
2-hydroxy-3-nitro-4'-dodecylbenzophenone oxime Other compounds, having the structure of formula (III) above are represented by 2-hydroxy-5-nonylcyclohexanone oxime, 2-hydroxy-4-dodecylcyclopentanone oxime, N-methyl-2-hydroxycyclooctanone oxime, N-propyl-2-hydroxy-4-dodecyl-cyclodecanone oxime and the like.

The chelating agents described above act as collector reagents in the flotation of, for example, sulfide ores. The higher molecular weight (circa above about 100) agents are collectors for oxide type ores while lower molecular weight agents act as promoters or activators. In the preferred method of the invention, the chelating agent is water-soluble or made water-soluble by the introduction of solubility promoting groups.

Those skilled in the art will appreciate that while deciding the nature of substituents in $R_1$–$R_{10}$ above, steric hindrance is a consideration. It is preferable not to have the substituents in a position immediately next to the chelating group, namely, —OH and =NOH. Therefore, substituents should preferably be not in the position β or ortho to either —OH or =NOH. The requirement is not very critical for chelation between the reagent and the metal ions in aqueous solution, but is critical for chelation between the reagent and the metal atom on the surface of the mineral where the metal, being part of the mineral bulk, is already partially coordinatively saturated; and therefore, if the substituent is too close to the chelating group it may offer steric hindrance to the chelate formation on the surface of the mineral. This is true if the chelating molecule is bulky, meaning thereby heavily branched hydrocarbon, aliphatic or aromatic, groups. Furthermore, if the reagent molecule contains substituents which are heavily branched, its water solubility will drastically decrease. It is, therefore, preferable to have straight chain hydrocarbon substituent than a branched chain hydrocarbon.

On the other hand, some of these requirements are not very critical for the application of the reagents in oil extraction flotation. For example, for oil extraction flotation it is preferable that the collector reagent be insoluble in water and soluble in the oil phase such as kerosene or fuel oil. Also a branched hydrocarbon substituent is preferred provided it does not offer steric hindrance to chelate formation on the surface.

As mentioned earlier, this steric hindrance is more critical on the surface of the mineral because the metal atom on the surface is already partially coordinatively saturated; and, consequently, only a part of the metal's coordination sphere is available for chelate formation with the collector reagent. Although we do not wish to be bound by any kind of theory, whatsoever, it is conceivable, on the basis of what is said about the steric restrictions on the surface of the mineral, that the metal chelate formed on the surface of the mineral might be different in structure and properties, at least partly or in full, from those of the metal chelate formed in the aqueous phase. This latter chelate, which is the same chelate that is extracted from the aqueous phase into the organic phase during solvent extraction, has been identified with regard to its structure and composition, at least in some cases. It is believed that the collector action of the reagents disclosed in this invention might be due to the formation of the metal chelate on the surface of the mineral and not due to the chelate formed in the aqueous phase.

We found a difference in the collecting property between isomers of reagents disclosed in this invention. It is known that unsymmetrical hydroxyoximes have at least two isomers. For e.g. 5-nonyl-2-hydroxybenzophenone oxime (LIX65N of General Mills) has two isomers: the anti-or the active isomer and the syn- or the inactive isomer. From laboratory studies of

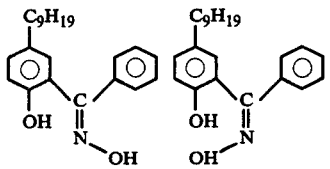

ANTI- SYNsolvent extraction of copper from aqueous copper solution using these isomers it has been found that only the anti- or the active isomer can form a chelate with copper; the syn-isomer cannot form such a chelate unless it is transformed into the anti-form. But to this date, and to the best of our knowledge, such a finding with regard to the formation, or lack of it, of a surface chelate and subsequent flotation, has not been reported in the literature for any reagent.

An important requirement the chelating agents must satisfy in order to function as collectors for minerals is that they should form an insoluble chelate with the metal on the surface of the mineral. The reagents disclosed in this invention do form an insoluble chelate with metals such as copper on the surface of copper minerals. Further, it is necessary that this surface chelate be bound to the mineral surface strongly.

The above-described chelating agent compounds may be used in the flotation of any copper-bearing ores. More specifically they may be used for the flotation of copper values from copper oxide type ores, including chrysocolla, cuprite, malachite, azurite, tenorite and the like and from sulfide type ores including chalcopyrite, covellite, chalcocite, digenite, enargite, tetrahedrite, bornite, and the like and from mixed oxide-sulfide type ores, and from other sources of copper such as native copper ores, slags, tailings, residues, segregated copper, precipitated copper powder, manganese nodules, sodium chloride-contaminated sea-bottom ore deposits and from complex polymetallic copper sulfide or oxide ores and the like.

Flotation techniques are so well known that details of the procedures need not be given here and those skilled in the art will be able to find, by trial and error, optimum conditions. However, we have found certain preferred conditions for carrying the method of the invention. For example, although both froth flotation and oil extraction flotations proceed well at ambient temperatures, it may be advantageous to carry such procedures out at a temperature within the range of from about 40° C. to 60° C. Temperatures above 80° C. or below 20° C. are not particularly useful.

The flotations may be carried out at pH ranges of from 2 to 12. Optimal pH conditions may be determined by trial and error and are influenced by the pKa value of the particular reagent used. However, the minerals themselves would offer restrictions on the pH range. If the pH is too low, e.g. less than 3.5, the solubility of the mineral would be so high as to release a substantial amount of Cu into solution and which would consume a corresponding amount of the reagent in the aqueous solution to form the aqueous chelate, thereby drastically affecting flotation. The same is true at pH values above 11 or 12. Therefore, preferred pH range is 4 to 11.5. Also, it is possible that some minerals are not amenable for flotation in the neutral pH region, say in the range of 6.5 to 8.5. For example, it may be possible to float sulfides of copper in this pH range but may not be possible to float oxides such as cuprite and chrysocolla.

The proportion of chelating agent employed in the process of the invention may be varied widely. The specific or optimum proportion depends on factors like:

(a) nature of minerals present in ore. Sulfides may need very small amounts of reagents, but oxides will need relatively large amounts of reagents.

(b) nature of the reagent itself. Some lower molecular weight reagents may have to be added in relatively large amounts while higher molecular weight reagents may be added in small amounts. The nature and type of substituent $R_1$–$R_{10}$ may also have some effect. In addition use of single compounds for chelation compared to mixtures of chelating agents will change the required proportions.

(c) presence of certain gangue minerals which may consume some reagent e.g. if the copper ore has a large proportion of ferric minerals such as hematite they may consume some chelating agent.

In general, one may employ 0.01 to 1 lb of chelating agent per ton of ore material. Preferably this is added in increments of from about 0.01 to 0.5 lbs/ton at each stage of flotation. In the preferred process of the invention, the mode of addition is not especially important. Accordingly, it is desirable to carry out the rougher and cleaner flotation with a single addition of the chelating agent at the beginning of the operation. However, stagewise addition of the chelating agents would be advantageous at times.

The pulp density for froth flotation may be that conventionally employed, i.e.; on the order of from about 15 to 30 percent solids by weight. For oil extraction flotation, 0.1 to 10 percent solids is an acceptable range. In the oil extraction process, the volume of oil may be from 10 to 21 percent by volume of the aqueous pulp.

The ore materials for froth flotation preferably are ground so as to provide at least 95 percent particles with a size of under 48 mesh. A desliming step may be necessary. For oil extraction flotation at least 95 percent of the particles should have a size of less than 400 mesh.

In the method of the invention, we prefer ore conditioning times of from 1 to 5 minutes for both froth and oil extraction flotations. Longer times may be employed if desired. Varying amounts of frothers, emulsifiers, and any other chemicals that may be necessary, in different stages of flotation may be used to advantage in order to achieve the best possible recovery and grade.

As mentioned earlier, conventional flotation techniques are relatively inefficient to recover mineral values from slimes or very fine size ore fractions. Related methods that are very convenient and that are very promising are: oil extraction flotation or oil flotation, oil agglomeration or spherical agglomeration, liquid-liquid extraction-flotation, collector-extender flotation, and emulsion flotation. According to this invention, oil extraction flotation, which is closely related to the other techniques mentioned above, is more promising, and offers an advantage over other techniques in that it is characterized by a cleaner separation between aqueous and the oil phases used. Briefly, this technique makes use of an oil phase, or a water immiscible organic phase in general, to collect mineral particles that have been selectively coated by a flotaid, inducing hydrophobicity to the particles and thereby facilitating collection of the mineral particles by the oil phase. About 10–20% oil (percent of aqueous slurry) are used for collection of mineral values from aqueous pulps containing up to 10% solids. The chelating agent collector selected from those described herein, up to about 1 lb/ton of ore, could either be present in the aqueous slurry (water-soluble collector) or in the oil phase (water-insoluble but oil-soluble collector). In this application, substituted hydroxyoximes of the formula (IV) above or the other chelating agents with active chelating nitrogen and oxygen atoms are used as flotaids to make copper minerals hydrophobic thereby causing them to collect in an oil phase such as kerosene or fuel oil.

The following examples describe the manner and process of making and using the invention and set forth the best mode contemplated by the inventors of carrying out the invention but are not to be construed as limiting.

In all of the flotation tests, the following general procedure was followed:

Preparation For Froth Flotation Tests

According to the present invention, mixtures of copper minerals such as chrysocolla, chalcopyrite, or chalcocite with gangue minerals such as quartz were prepared by grinding together required amounts of the −14 mesh minerals in a laboratory porcelain ball mill. The ground mixture of minerals was then wet screened to obtain about 500 g. of −65 + 325 mesh fraction. The fraction was then conditioned in a Denver flotation cell at 1800 rpm with about 1200 milliliters of deionized water at the desired pH.

Collector reagent was dissolved in a solvent such as hexane (this solvent could very well be kerosene or fuel oil or like inexpensive commercial solvents) and the required amount of the resulting hexane solution was added to 500 milliliters of deionized water at a desired pH and containing an emulsifier such as Tergitol® (Union Carbide Corp.), and the contents were emulsified for 10 minutes. 1 g. of Dowfroth 250, a polypropylene glycol methyl ether (Dow Chemical Company) was dissolved in 100 ml. of water to obtain a solution of 10 g. frother per liter of solution. Other frothers such as pine oil of methyl isobutyl carbinol can also be used instead of Dowfroth 250.

A water solution of sodium isopropyl xanthate was also prepared for use in comparative flotation tests.

Flotation Tests

The collector emulsion prepared as described above was then introduced into the flotation cell in which the minerals mixture had been conditioned with deionized water. The pulp level in the cell was made up to 2500 ml. The minerals mixture was then conditioned with the collector emulsion at 1800 rpm. The frother solution was added to the pulp in the cell during conditioning. pH was continuously monitored during conditioning.

EXAMPLE 1

480 g. of −65 + 325 mesh fraction of Chrysocolla-quartz mixture assaying about 2% Cu was charged into the flotation cell and conditioned for 4 min. first at 1500 RPM with distilled water at pH 10.6 and next at 1800 rpm and pH 10.6 for 4 min. with the collector emulsion containing 0.069 lb/ton of emulsifier and about 1 lb/ton of anti-5-nonyl-2-hydroxybenzophenone oxime (LIX65N, General Mills) in hexane (6.1 lb/t). Amount of frother added during conditioning was 2 ml. (0.09 lb/t). The solids were floated at 1500 rpm and 8.5 lits/min of air, for 4 minutes. Final pH was 10.32.

The rougher concentrate obtained above was cleaned at pH 10.0, air flow rate at 6.5 liters/min and 0.7 ml frother.

A recleaning of the first cleaner concentrate was done at pH 9.7. The concentrate was floated for 2½ minutes.

A scavenger flotation of the 1st and 2nd cleaner tailings was also carried out.

The metallurgical results obtained are presented in Table I below.

Table I

| | Flot time sec. | Weight % | % Cu | Distribution % Cu | Overall Recovery |
|---|---|---|---|---|---|
| Feed | | 100 | 2.13 | 100 | |
| Cleaner Concentrate 1 | 0– 20 | 4.7 | 31.30 | 69.0 | |
| Cleaner Concentrate 2 | 20– 60 | 3.1 | 8.44 | 12.42 | |
| Cleaner Concentrate 3 | 60–150 | 10.1 | 2.17 | 10.30 | 91% |
| Cleaner tailings | | 31.0 | 0.35 | 5.15 | |
| Rougher tailings | | 51.1 | 0.13 | 3.17 | |

EXAMPLE 2

538 grams of −65 + 325 mesh fraction of a mixture of chrysocolla, chalcopyrite, chalcocite and quartz was made into an aqueous pulp in the flotation cell and was conditioned for 4 minutes first at 1500 RPM with distilled water at pH 10.6 and next at 1800 rpm and a pH of 10.6 for 4 min. with the collector emulsion containing 0.04 lb/t of emulsifier and 0.93 lb/t of Anti-5-nonyl-2-hydroxybenzophenone oxime in hexane (about 6 lb/ton). Amount of frother added during conditioning was 2 ml. The mixture was floated at 1500 rpm and 8.5 lit/min of air, for 4 min. Final pH was 10.1. The rougher concentrate obtained at this stage was cleaned 3 times, the 3rd cleaning being at pH about 7–8, 1300 rpm and 4.5 lit/min air, and three flotation fractions were collected during this 3rd cleaning. The metallurgical results are given in Tabe II below.

Table II

| | Flot time sec. | Weight % | % Cu | Distribution % Cu | Overall Recovery |
|---|---|---|---|---|---|
| Feed | | 100. | 2.08 | 100. | |
| Cleaner Concentrate 1 | 0– 20 | 3.53 | 40.10 | 68.21 | |
| Cleaner Concentrate 2 | 20– 60 | 3.44 | 14.10 | 23.33 | |
| Cleaner Concentrate 3 | 60–180 | 1.67 | 5.0 | 4.03 | 96% |
| Cleaner tailings | | 27.67 | 0.16 | 2.13 | |

Table II-continued

| | Flot time sec. | Weight % | % Cu | Distribution % Cu | Overall Recovery |
|---|---|---|---|---|---|
| Rougher tailings | | 63.70 | 0.075 | 2.30 | |

The results given in Table I and Table II clearly demonstrate the ability of the type of collector reagents disclosed in this invention to successfully float both sulfide and oxide copper values without any kind of pretreatment. The results also demonstrate the high recovery and grade obtainable using this type of collector reagents.

It can be seen from Table II that the copper rejected in the tailings is substantially low, the concentrates are of very high grade, and the recovery, taking the first three fractions, is over 95%.

Our results also indicated that sulfides floated much more readily and easily than oxides. This suggested that the sulfides may be floated at a much lower reagent level, and, therefore, a stagewise addition of collector reagent would be advantageous. This would reduce the reagent consumption and the following example illustrates this.

EXAMPLE 3

A flotation test was carried out as in Example 2 with 0.021 lb/t of emulsifier and 0.485 lb/t total of the same collector reagent as in examples 1 and 2. Of this amount of the collector reagent, about 0.05 lb/ton was added in the first stage of flotation to float all sulfides. In the second stage flotation the tailings of the first stage were treated with the remaining amount of the collector reagent. The conditioning time in each stage was 4 min. at a pH of about 10.3–10.4. The metallurgical results are given in Table III, below.

Table III

| | Flot time sec. | Weight % | % Cu | Distribution % Cu | Overall Recovery |
|---|---|---|---|---|---|
| Feed | | 100. | 2.2 | 100. | |
| 1st Stage | | | | | |
| Concentrate | 0–240 | 2.31 | 44.7 | 47.13 | |
| 2nd Stage: | | | | | |
| Cleaner Concentrate 1 | 0– 60 | 2.42 | 34.7 | 38.11 | |
| Cleaner Concentrate 2 | 60–120 | 2.51 | 4.28 | 4.90 | 90% |
| Scavenger Concentrate | 0–240 | 8.11 | 0.82 | 3.04 | |
| Scavenger tailings | | 21.00 | 0.21 | 2.00 | |
| Rougher tailings | | 63.70 | 0.17 | 4.84 | |

It is clear from the results in Table III that stagewise addition of the chelating agent as a collector reagent is very advantageous. Almost 100% recovery of sulfides is obtained with as low a collector reagent amount as 0.05 lb/t. Our results suggest that the collector reagent quantity could be further reduced to as low as 0.01 lb/t. It is also clear from Table III that oxides are also almost completely recovered. The grade of concentrates is excellent (45% Cu for sulfide-rich concentrate and 35% Cu for oxide-rich concentrate). Our tests have shown that cleaning is not necessary for the concentrate obtained in the first stage. Three cleaning steps have been employed for the concentrate obtained in the second stage flotation (i.e., oxide-rich). During second and third cleaning, milder conditions such as 1300 rpm and 4 to 4.5 lit/min of air were employed, and the pH was near neutral.

EXAMPLE 4

This example is not an example of the invention but is made for comparative purposes.

Following the procedure of Example 1, supra, but replacing the anti-5-nonyl-2-hydroxybenzophenone as used therein with 3 lbs/ton of sodium isopropyl xanthate (no emulsifier) at a pH of 10.0–10.5 and increasing the proportion of chrysocollaquartz mixture to 500 gms a flotation test is carried out. Because of slow flotation of chrysocolla using xanthate the pulp was floated for a total of 20 minutes. The metallurgical results are shown in Table IV below.

Table IV

| | Flot time sec. | Weight % | % Cu | Distribution % Cu | Overall Recovery |
|---|---|---|---|---|---|
| Feed | | 100. | 2.42 | 100. | |
| Concentrate | 20 | 4.86 | 24.11 | 48.5 | 48.5 |
| Tailings | | 95.14 | 1.31 | 51.5 | |

It is clear from Table IV that xanthate even at as high quantities as 3 lb/ton has not been able to float chrysocolla satisfactorily. Less than 50% of chrysocolla was recovered after an unduly long flotation period of 20 minutes.

EXAMPLE 5

A. Preparation For Oil Extraction Flotation

Mixtures of chrysocolla and quartz were prepared and ground in the same way as described above under "Preparation for Froth Flotation Test." The −325 fraction which was obtained during wet screening after grinding was made into an aqueous pulp and screened through 400 mesh. The −400 mesh fraction was resuspended in water and allowed to settle for about two minutes. The settled solids were rejected and the aqueous pulp was made up with water so as to contain about 0.2–5% solids.

B. Oil Phase Preparation

An oil phase was prepared by dissolving an admixture of 2-hydroxy-5-dodecyl-benzophenone oxime and about 1 percent of 5,8-diethyl-7-hydroxy-6-dodecanone oxime (LIX-64, General Mills) in kerosene in the volume ratio 1:100.

C. Oil Extraction Flotation

In a typical oil extraction test, the aqueous pulp described above was mixed vigorously at room temperature for about 4 minutes with 15 vol % of the oil phase described above. The mixture was then allowed to separate into two layers.

In about 10 to 15 minutes the oil phase separated out from the aqueous pulp and formed the top layer. Almost all of the copper values (chrysocolla in this example) along with a small amount of quartz collected in or at the oil phase (top layer) leaving most of the quartz either in suspension in the aqueous phase or settled at the bottom. The pH was about 5.5 to 6.0. The two layers were easily separated from one another and thus collecting the copper values separately. Cleaning of the concentrate improved the grade without affecting the recovery. The results are given in Table V below.

This example demonstrates the ability of the chelating agents disclosed in this invention to recover copper values from fine size fractions by the technique of oil extraction flotation under conditions similar to those employed in flotation tests to obtain satisfactory recovery and grade.

EXAMPLE 6

410 g of the −65+325 mesh fraction of an oxide-type copper ore assaying about 1% copper is made into an aqueous plup in a flotation cell and conditioned for 6 minutes in the first stage at 1800 rpm and a pH in the range of 5.5–7.0. With the collector emulsion containing 0.006 lb/ton of emulsifier and 0.19 lb/t of a mixture of 2-hydroxy-5-dodecylbenzophenone oxime and 1% of 5,8-diethyl-7-hydroxy-6-dodecanone oxime (LIX-64, supra).

The ore is floated at 1500 rpm and 8.5 lit/min of air, for 5 min. The tailings of first stage are then resuspended in fresh water and conditioned for 4 min. at 1800 rpm and a pH of 4.5–5.0 with the same amount of oxime as above in the first stage, and floated for 4 mins at 1500 rpm as before. The tailings from this second stage are again resuspended in fresh water, conditioned for 4 min. at pH 10.35 with the same amount of oxime as before, and floated for 4 min.

The total weight of concentrate from all the three stages is 10g. This concentrate appeared to be of a very high grade, and the recovery of copper appeared to be more than 70%. A characteristic feature of flotation in the presence of the mixture of 2-hydroxy-5-dodecylbenzophenone oxime and 5,8-diethyl-7-hydroxy-6-dodecanone oxime compound to the use of anti-5-nonyl-2-hydroxybenzophenone oxime, is that concentrates obtained with the use of the former are higher in grade, requiring no cleaning at all because very little or no gangue minerals float with the LIX-64.

Repeating the above procedure of Example 6 but in a pH range of from 10 to 11, flotation is even more selective and cleaner.

Similarly, repeating any of the above Examples 1–4 and 6 but replacing the chelating agent as used therein with any other chelating agent having within its structure the moieties set forth in the formulae (I), (II) and (III), an efficient flotation separation of copper is made.

Those skilled in the art will appreciate that although the invention has been described in relation to the separation of copper from copper-bearing ores, the full scope of the invention includes the use of the described chelating agents in the separation of any transition group metal such as iron, cobalt, nickel, vanadium, molybdenum, niobium, manganese, palladium and tungsten and also germanium, tin and lead from materials such as ore bodies containing such metals.

Table V

| | Pulp Density Wt. % of Solids | Total Volume, ml aqueous | Total Volume, ml organic | % Cu. Feed | % Cu. Cleaner Concentrate | % Cu. Tailings | Overall Recovery % Cu. |
|---|---|---|---|---|---|---|---|
| #3 | 2.3 | 250 | 37.5 | 3.12 | 17.40 | 0.072 | 94.54 |
| #4 | 0.32 | 250 | 37.5 | 3.00 | 13.94 | 0.08 | 97.8 |

What is claimed is:

1. In a process of froth flotation for the separation of a metal including copper from a material bearing the metal, the improvement which comprises; carrying out the flotation in the presence of anti-5-nonyl-2-hydroxybenzophenone oxime as the collector reagent and recovering at least copper.

2. The process of claim 1 carried out at ambient temperatures.

3. The process of claim 1 carried out at a temperature of from about 40° C. to 60° C.

4. The process of claim 1 carried out at a pH of from 2 to 12.

5. The process of claim 1 wherein the proportion of flotaid present is within the range of from 0.01 to 1 lb. for each ton of material.

* * * * *